United States Patent [19]

Courvoisier

[11] 4,335,859

[45] Jun. 22, 1982

[54] DEVICE TO REMOVE BOBBINS FOR AN OPEN-END SPINNING MACHINE

[75] Inventor: Guy Courvoisier, Geneva, Switzerland

[73] Assignee: Officine Savio S.p.A., Pordenone, Italy

[21] Appl. No.: 137,291

[22] Filed: Apr. 3, 1980

[30] Foreign Application Priority Data

Apr. 5, 1979 [CH] Switzerland ..... 3178/79

[51] Int. Cl.[3] ..... B65H 54/26; B65H 67/04

[52] U.S. Cl. ..... 242/35.5 A; 242/19

[58] Field of Search ..... 242/35.5 A, 35.5 R, 242/18 R, 18 A, 18 DD, 18 PW, 19, 35.6 R

[56] References Cited

U.S. PATENT DOCUMENTS

| | | | |
|---|---|---|---|
| 3,476,328 | 11/1969 | Shimai et al. | 242/35.5 R |
| 3,791,126 | 2/1974 | Kose et al. | 242/35.5 A |
| 3,820,730 | 6/1974 | Endo et al. | 242/35.5 A X |
| 3,940,076 | 2/1976 | Kato et al. | 242/35.5 A X |
| 3,940,077 | 2/1976 | Ohashi | 242/35.5 A |
| 3,948,452 | 4/1976 | Burysek et al. | 242/35.5 A X |
| 3,971,520 | 7/1976 | Shimai | 242/35.5 A |
| 4,116,395 | 9/1978 | Courvoisier | 242/35.5 A |
| 4,125,990 | 11/1978 | Stahlecker et al. | 242/35.5 A X |
| 4,139,162 | 2/1979 | Stahlecker | 242/35.5 A |
| 4,178,748 | 12/1979 | Stahlecker et al. | 242/35.5 A X |

FOREIGN PATENT DOCUMENTS

| | | | |
|---|---|---|---|
| 2828868 | 1/1979 | Fed. Rep. of Germany | 242/35.5 A |
| 1484249 | 5/1967 | France | |

*Primary Examiner*—Stanley N. Gilreath

*Attorney, Agent, or Firm*—Stevens, Davis, Miller & Mosher

[57] ABSTRACT

A device for the removal of bobbins in open-end spinning machines comprising a stirrup bearing a bobbin, a holding organ solidly attached to a rod of a first jack joined to a pivoting element driven by a second jack, an arm discharging the bobbin bearing an articulated pipe connected to a suction means and a device to shear the yarn, the device being fitted so that it can swivel around an axis and driven by a third jack, the device discharging the bobbin while passing between the arms of the raised stirrup, a transfer organ driven by a fourth jack serving to bring the empty tubes from a storage point to between the arms of the stirrup and a hook shifting around an axis by a fifth jack so as to bend the trajectory of the yarn and bring it near to an arm of the stirrup so as to create a reserve of yarn while the winding of a new bobbin is being started.

10 Claims, 11 Drawing Figures

FIG. 10
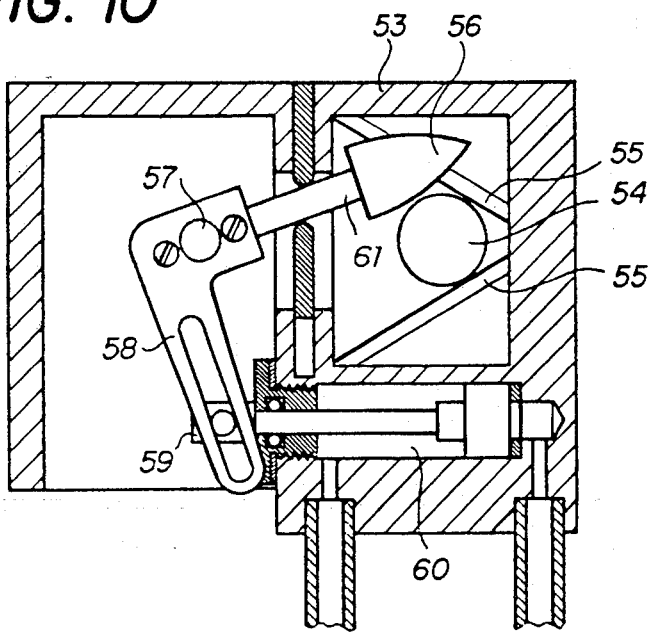
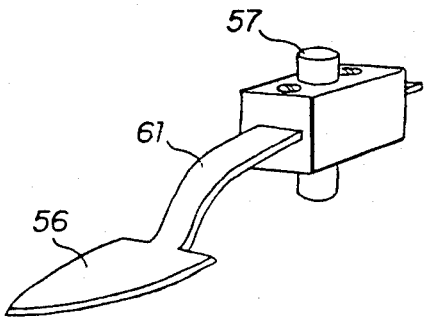
FIG. 11

DEVICE TO REMOVE BOBBINS FOR AN OPEN-END SPINNING MACHINE

The invention relates to a device for removing bobbins from an open-end spinning machine.

Each time that a bobbin containing yarn produced by a spinning machine is full, it has to be removed and replaced with an empty winding tube. This operation may be carried out by hand, semi-automatically or automatically. Automation of the removal work involves various problems such as; restarting the winding on an empty tube which is a considerable and delicate problem if it is to be overcome with almost full security.

There already are devices for removing bobbins in which the overall problems involved have been more or less overcome. However, these devices are generally very complicated and require the action of mechanisms to transform rotary movements into straight movements, and this necessitates electric motors, connecting rods and relatively sophisticated mechanical elements which lead to expensive arrangements and rather delicate working subject to frequent breakdowns and an appreciable percentage of failures. Moreover, maintenance and periodic adjustments are needed rather often.

The purpose of this invention is to simplify the automatic removal apparatus so as to reduce its cost and also to set forth a strong arrangement which can work with a minimum of maintenance and perform with very great reliability. Furthermore, the arrangement has been especially designed to ensure maximum security at the time of the re-starting of the winding process, which represents the most delicate working phase.

With this in view the invention has as its object a device for removing bobbins from an open-end spinning machine whereby each bobbin is mounted in a rotating manner between two elastic arms of a supporting stirrup connected by a joint to the framework of the machine and resting against a driving shaft of the machine. The device is characterized by comprising:

an organ to activate the stirrup, the organ being associated with first guide means that provide for the organ a direction of movement contained in a plane perpendicular to the axis of articulation of the stirrup and adjacent to the inner face of one of its arms, second guide means to provide for the activating organ a direction of movement contained in a plane at right angles to the previous plane, means to move the activating organ according to each of the aforesaid directions of movement and between at least two respective limit positions, an organ to discharge the bottom, the organ being associated with guide means defining a trajectory for the discharge organ that passes between the arms of the stirrup when the axis of rotation of the bobbin on that stirrup is separated from the driving shaft by a given distance, means to move the discharge organ along its trajectory between at least two limit positions, which are the positions of rest and discharge respectively, a duct to aspirate the yarn, the duct being solidly fixed to the discharge organ, a mechanism to transfer winding tubes, the mechanism being associated with guide means to transfer a tube from a supply storage point to between the arms of the stirrup, and a cutting organ to free the yarn from the aspiration duct at the discharge position of the discharge organ.

The simple nature of this device lies essentially in the fact that each organ can be linked directly to the means causing movement without any need for an intermediate means to transform movement. Owing to this, the device lends itself particularly well to a fully pneumatic drive, which is especially important from a cost point of view. Moreover, each spinning machine of this type involves a compressed air supply to which the various motor organs of the device can be readily connected.

The attached figures show diagrammatically as examples a method of realization and some variants of the device which is subject to the invention in which:

FIG. 10 is a cut-away view of a detail of FIG. 8.

FIG. 11 is a perspective of a detail of FIG. 10.

Figure 1:
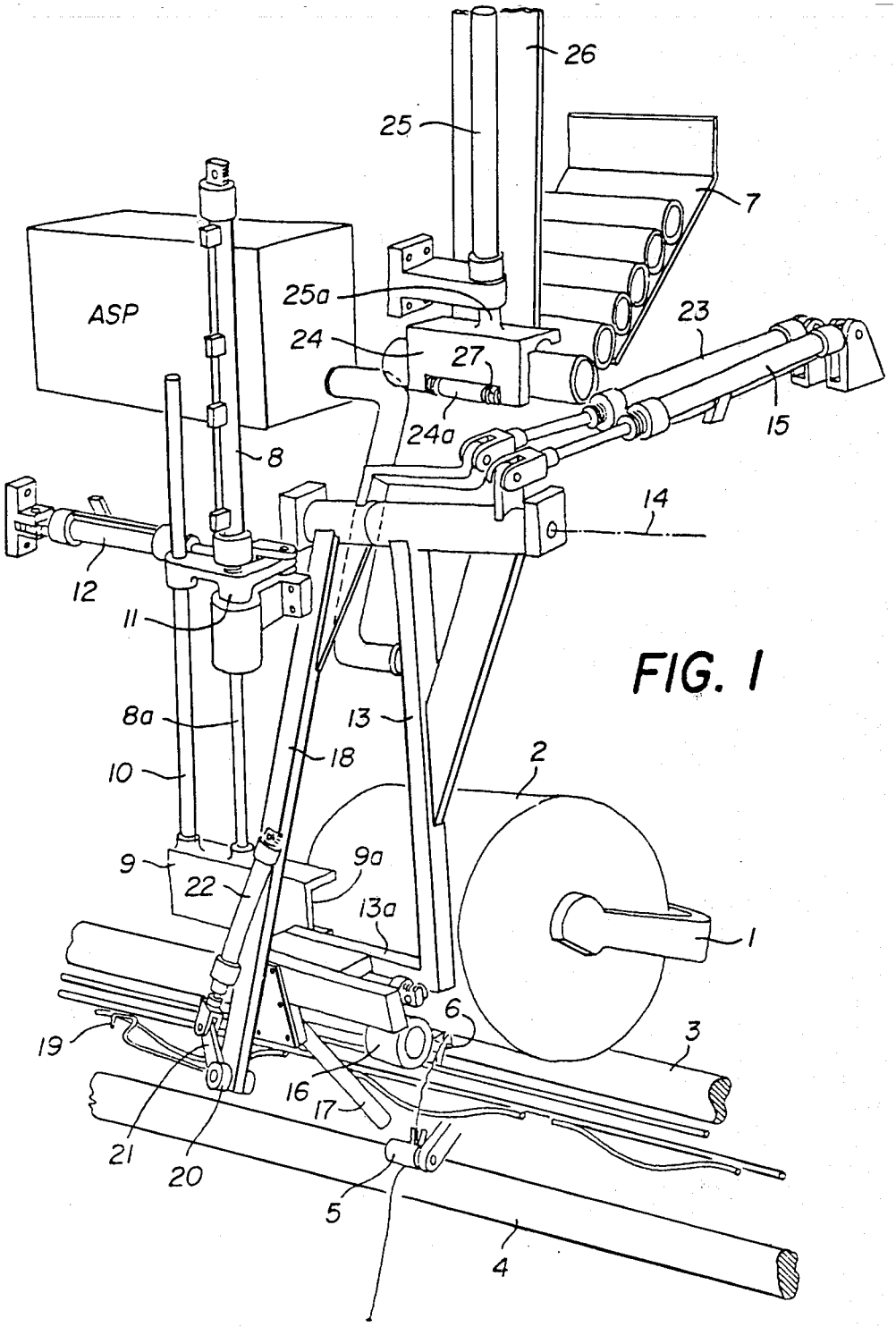
FIG. 1 is a perspective view of the device of the invention.

Besides the actual removal device itself, FIG. 1 shows elements of the spinning machine which are needed for an understanding of the invention. These elements are the stirrup 1 providing swinging support for the bobbin 2, the shaft 3 rotatably driving the bobbin, the shaft 4 withdrawing the yarn and its pressing roller 5 and the back and forth sliding means 6 intended to produce constant winding from one edge to the other of the bobbin. Furthermore, a loader 7 for tubes associated with a storage point (not shown here) form part of the system for feeding tubes which accompanies the actual removal device itself.

The removal device consists essentially of four parts. The first part of the device comprises a rod 8*a* of a jack 8 which ends in a gripping element 9, which comprises when seen in profile a rectangular space 9*a* intended to lodge one of the arms of the stirrup 1, as will be explained later on. This element 9 is, furthermore, solidly fixed to a rod 10 parallel to the rod 8*a* and fixed elsewhere to one of the branches of a swivelling element 11, which has two branches and is fitted so as to be able to swing around the rod 8*a*; the other branch of the swivelling element 11 is pivotally fixed to the rod of a drive jack 12 in such a way that the element 9 can rotate around the lengthwise axis of the rod 8*a* when driven by the jack 12.

The second part of the device is intended to carry out two functions successively and comprises an arm 13 articulated around an axis 14 and driven by a jack 15. The free end of the arm 13 has an attachment comprising a branch 13*a* at right angles thereto, which bears a pair of free-turning rollers 16, an articulated pipe 17, which will be described later on in detail, and also a cutting mechanism, which is not visible in the figures but which will also be reviewed in detail. For the moment it is enough to know that the pipe 17 is connected to a source of aspiration ASP through the hollow arm 13 and 13*a* and that the length of the branch 13*a* has been chosen so that it can pass between the arms of the stirrup 1 when the arm 13 swings according to the drive of the jack 15.

The third part of the device is intended to create a reserve of yarn at one end of the winding tube. This part, therefore, is optional because it does not take a direct part in the removal operation. It comprises an arm 18 articulated around the same axis 14 as the arm 13; the arm 18 ends in a hook 19 articulated around an axle 20 and activated by an arm 21 pivotally fixed to a jack 22. The arm 18 too is pivotally fixed to a jack 23, which is intended to make the arm pivot around the axis 14.

Lastly, the fourth part of the device consists of an element 24 to transfer tubes. The element comprises a rod 25*a* driven by a jack 25. This element 24 is in the form of a gripping means of which one of the jaws 24*a* is equipped with elastic return means 27. The element 24 is solidly fixed to a plate 26 intended to retain the tubes in the storage point 7 when the jack 25 makes the element 24 descend.

Figure 3:
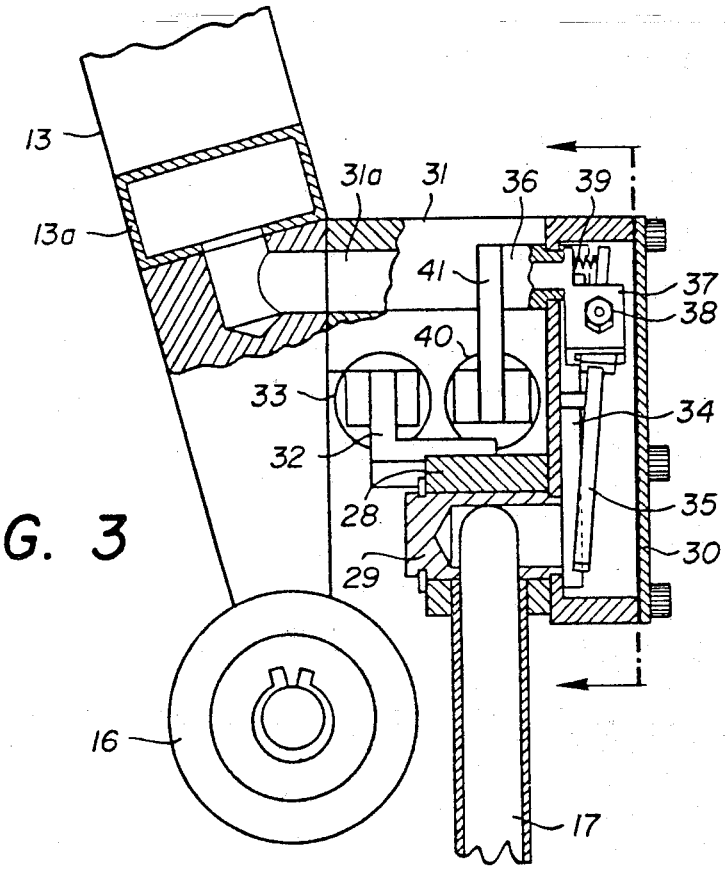
FIG. 3 is a partially cut-away side view of a detail of the device.
Figure 4:
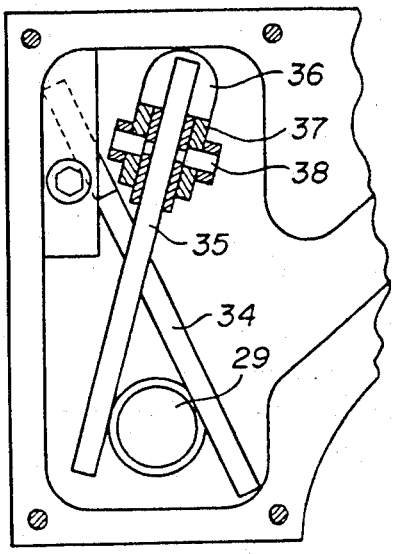
FIG. 4 is a cut-away enlarged view along IV—IV of FIG. 3

FIGS. 3 and 4 show in greater detail and on a larger scale the various elements fixed to the free end of the arm 13. With reference first to FIG. 3, it can be seen that one of the free-turning rollers 16 as well as the pipe 17 are solidly fixed to a sleeve 28 mounted so as to pivot around a bush 29 fixed to a box 30 connected to the branch 13*a* of the arm 13 with a connecting piece 31, in which there is a duct 31*a* which links the inside of the box 30 to the duct made in the branch 13*a*. The latter duct being itself connected to a source of aspiration ASP by the hollow arm 13. The sleeve 28 is solidly connected to a pin 32 articulated together with the rod of a jack 33 in such a way that the pipe 17 can pivot around the bush 29. The bush 29 has a central bore or hole.

The inside of the box 30 comprises a cutting device which includes a pair of shears 34 and 35, of which one 34 is immobile while the other 35 is fixed to a shaft 36 by means of a connector 37, on which the shears 35 is articulated around a crosswise axle 38. A spring 39 pushes the shears 35 to make it swing clockwise (FIG. 3) around the axle 38. The shaft 36 is connected to the rod of a jack 40 by a pin 41. In its position of rest the shears 35 lies at a tangent to the edge of the hole made in the bush 29, while the other, immobile shears 34 lies at a tangent to the opposite edge of the same hole. Moreover, the hole is freely open so as to permit a free passage for the yarn through the hole and therefrom in the direction of the branch 13*a* through the duct 31*a* in the connecting piece 31.

A double ramp 42 and a conveyor belt 43 (FIG. 2) serve to withdraw the full bobbins.

FIG. 1 shows the starting position of various parts of the removal device at the moment when the device is brought in front of the spinning station at which it is necessary to remove the bobbin 2. In fact the device described has been envisaged as serving a plurality of spinning stations. For this purpose it has been visualized that the device described will be fixed to a framework (not shown here) which is mounted so that it can run along the spinning machine by means of a rail. Such details regarding the devices are well known, and their presence here is not needed for the understanding of this invention, of which they are not a part. For the purpose of the operation the device described is brought in front of the spinning station by some known transfer and positioning means.

Figure 5:
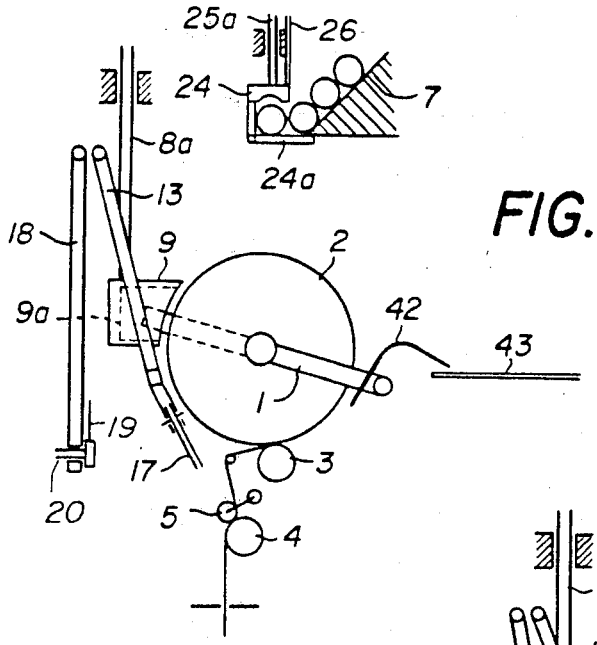
FIG. 5 is a diagrammatic side view of the device in the working position

Starting from the position of FIG. 1, the device is brought to the position shown diagrammatically by FIG. 5, that is to say, the jack 8 has swung by a quarter of a turn owing to the drive of the jack 12 so as to put the gripping element 9 in contact with the arm of the stirrup 1, which stretches on the outside of the bobbin 2. The extended arm of the stirrup is ready to carry out manual removal. It is elastic in such a way that it can be separated from the opposite arm of the stirrup so as to release the bobbin. It should be further noted, as regards FIG. 5, that the arm 13*a* has been brought near to the bobbin 2 and that its aspiration pipe 17 is close to the yarn produced and wound onto the bobbin 2. For the time being the winding of the yarn goes on normally. This phase, therefore, is a stage for preparation of the bobbin removal without the latter interfering with the winding.

Figure 6:
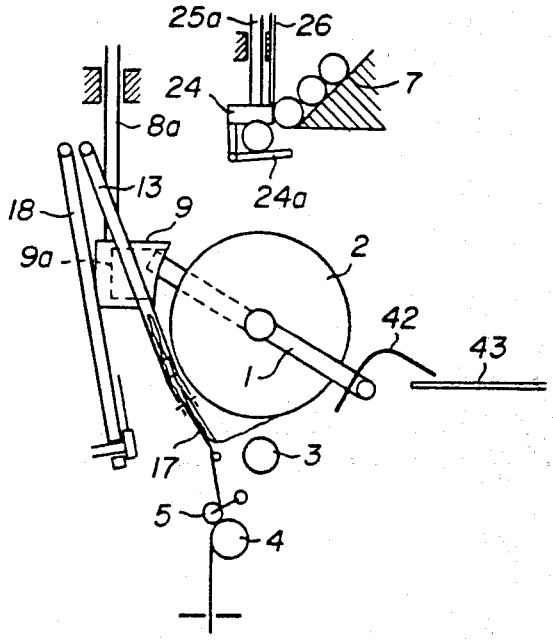
FIG. 6 is a diagrammatic side view of the device in a second working position.

In the next subsequent phase, shown in FIG. 6, the rod 8*a* of the jack 8 is raised and the holding element 9 lifts the stirrup 1, which separates the bobbin 2 from the driving shaft 3. From that time the yarn being produced is no longer wound onto the bobbin; the yarn, which continues to be pulled by the withdrawal shaft 4 and the pressure roller 5, then forms a loop, which stretches towards the aspiration pipe 17, which then aspirates this yarn little by little to the extent that the latter is pulled by the shaft 4 and the roller 5.

Figure 2:
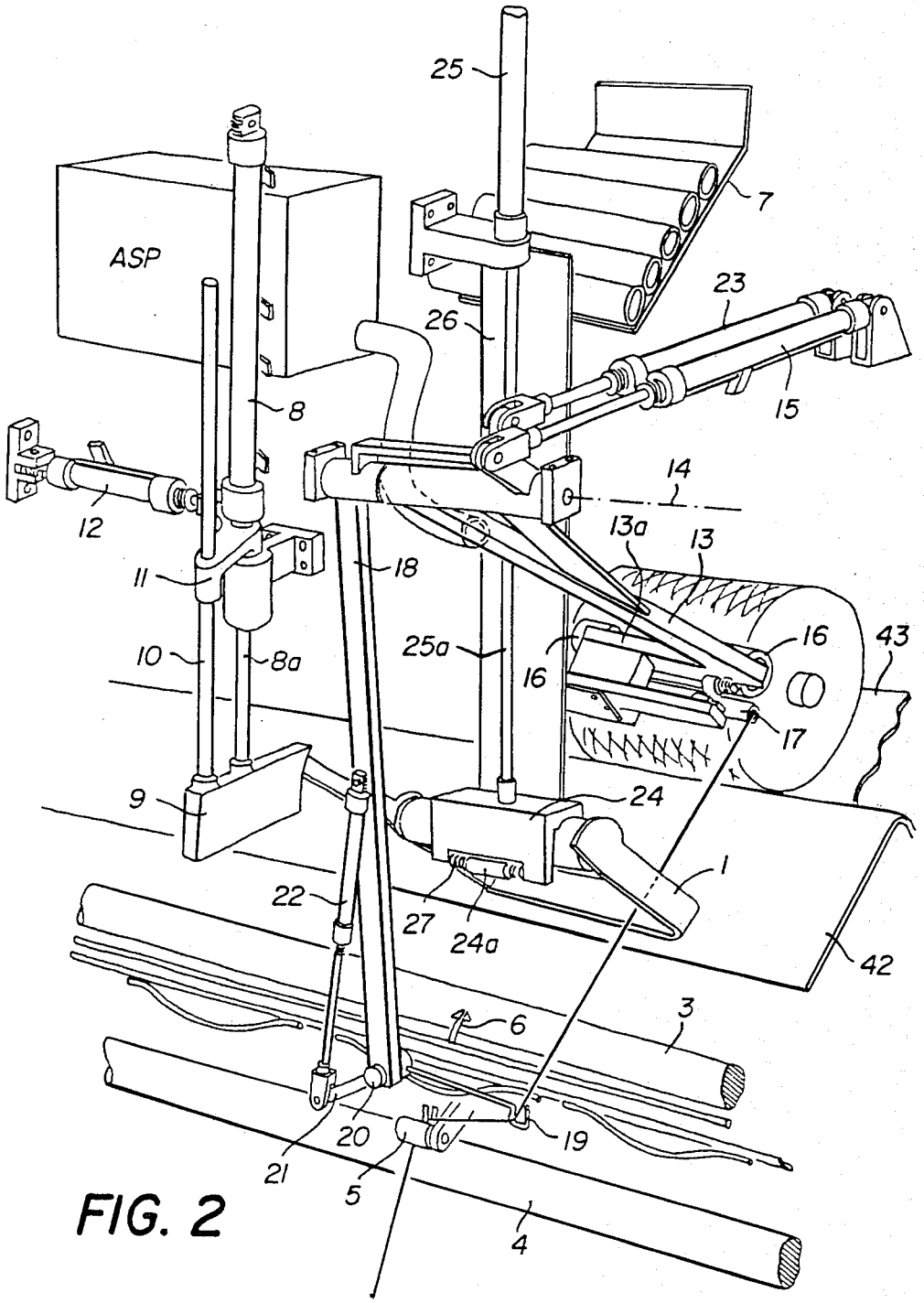
FIG. 2 is a perspective view of the device of the invention showing the device in another working position.

The following stage is shown in more detail in FIG. 2, which gives a better view of certain details than the diagrammatic views and, in particular, of the positioning of the yarn and the part played by the hook 19. During this stage the holding element 9 first pivots slightly around the rod 8*a* of the jack 8, owing to the drive of the jack 12, in a counter-clockwise direction once again. The purpose of this pivoting is to shift the extended arm of the stirrup away so as to release the bobbin 2. Immediately afterwards the arm 13 carries out a swinging movement towards the machine; its rollers 16 contacting the bobbin 2, removing the latter from the stirrup 1 and pushing it into the double ramp 42 until the bobbin has passed over the ridge formed at the junction of the two ramps 42, after which the bobbin rolls freely onto the conveyor belt 43.

Thereafter it can be seen that the aspiration pipe 17 has swung towards the right so that it is almost parallel to the branch 13*a*. At the same time the yarn is cut by the shears 34 and 35, and the bobbin 2 is thus freed and can be withdrawn by the conveyor belt 43, while the yarn produced by the spinning unit is aspirated little by little in full by the pipe 17. These two operations are governed by the jacks 33 and 40 respectively, which are solidly fixed to the arm 13.

During the same phase the hook 19 pivotally fixed to the arm 18, which has already been shifted forwards by the jack 23, is displaced towards the right (FIG. 2) by the action of the jack 22 on the arm 21.

During this movement the rod of the hook 19 meets the yarn and makes it slide towards the end formed like a hook. As FIG. 2 shows, the yarn is then stretched between the apsiration pipe 17 and the hook 19 and passes near one of the arms of the stirrup 1, being thus put outside the run of the sliding means 6.

Lastly, the rod 25*a* of the jack 25 has descended and brought the tube holder 24 between the arms of the stirrup 1. This tube holder grips with its movable jaw 24*a* a tube to be wound. The plate 26 neighbouring the outlet of the storage point 7 hinders the escape of the other tubes. The strand of yarn stretched between the pipe 17 and the hook 19 lies between the driving shaft 3 and the empty tube brought down between the arms of the stirrup.

Meanwhile, the gripping element 9 swings slightly in a clockwise direction, just enough to enable the arms of the stirrup 1 to grip the tube between them, in the meantime keeping the stirrup raised.

Figure 7:
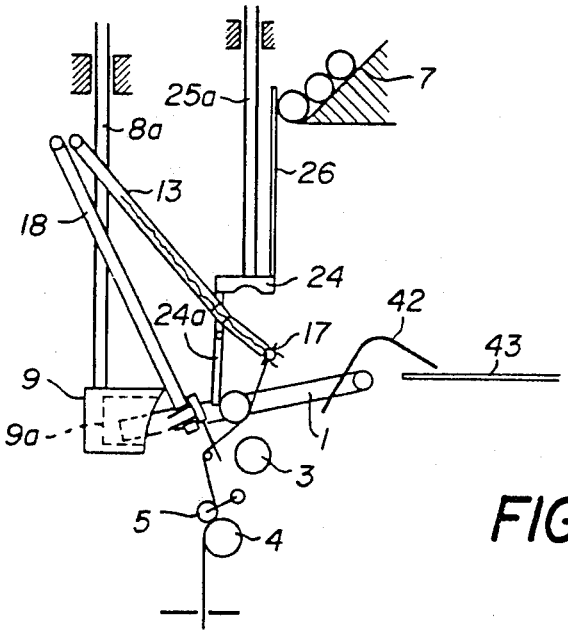
FIG. 7 is a diagrammatic side view of the device in a third working position.

FIG. 7 shows the next phase, during which the rod 8*a* lowers the stirrup 1 with the help of the gripping element 9. During this movement the tube held by the stirrup 1 is released from the tube holder 24, which opens its jaw 24*a*. The tube to be wound meets the strand of yarn stretched between the aspiration pipe 17 and the hook 9 and pulls it so as to grip it against the driving shaft 3. At the same time the shears 34 and 35 cut the yarn for the second time so as to free it. The edge of the tube to be wound which presses the yarn against the driving shaft has some retaining means, such as some small rough areas or a tacky area or other like known means, for instance, so that the yarn coils around the tube but only towards the edge thereof, on an area of the tube outside the normal zone on which the sliding means 6 causes the winding to sweep back and forth. The portion of the yarn thus wound serves to form a reserve intended to enable users to connect together the end of a bobbin used and the beginning of the next bobbin; in this way there is no need to stop the machine when the bobbin is changed.

After some revolutions of winding the hook 19 is brought to the position shown in FIG. 1, thus freeing the yarn stretched between the pressure roller 5, withdrawal shaft 4 and righthand edge of the tube being wound. During its back and forth movement the sliding means 6 engages the yarn in its guide slot and begins to sweep back and forth with the yarn so as to form a new bobbin.

The arm 13 is again brought backwards by passing above the tube, which is still almost empty. The tube holder 24 is brought opposite the storage point 7. As can be seen in FIG. 5, the jaw 24*a* is big enough for its free edge to meet the lower end of the feeding ramp of the storage point 7, so that when the jaw 24*a* goes upwards again it is opened against the pressure of the return spring 27 during the end of the run of the rod 25*a* of the jack 25 and thus enables a new tube for winding to be gripped. The device is then ready to be shifted towards another spinning station so as to carry out another removal of a bobbin.

It should be noted that all the functions in the device described are performed through the pneumatic drive of jacks. Thus this solution is very simple and all the movements are caused directly without intermediate actions. The reliability of the device and of its working is the outcome of the simplicity and of the fact that the start of the winding of the yarn of the new winding tube is caused by the gripping of the yarn when the tube is lowered. This solution is practically unable to meet with any failure because the start is a passive function, that is to say, it is not that the yarn is brought against the bobbin but that the yarn is present when the bobbin comes into contact with the driving shaft in such a way that the yarn is gripped, this being yet another assurance that the start of winding will be successful.

Figure 8:
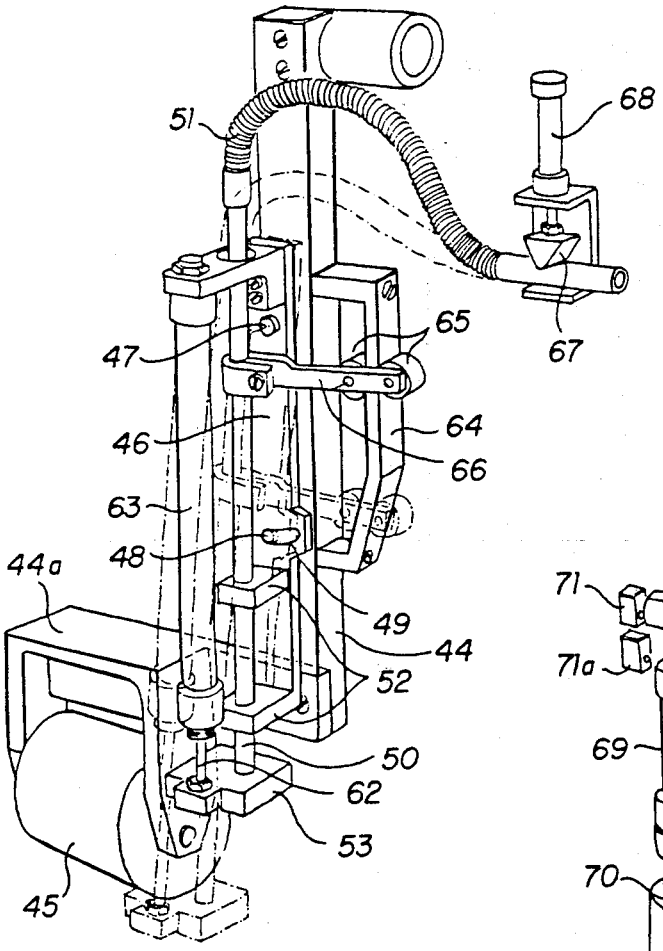
FIG. 8 is a partial perspective of a variant of the device.

The variant of FIG. 8 refers essentially to the second part of the device, which comprises an arm 44 articulated around the same axis 14 as the arm 13 of FIGS. 1 and 2; the drive jack of this part has not been shown because it is like the jack 15 shown in the FIGS. 1 and 2. The free end of the arm 44 also has a branch 44*a* at right angles, which bears a free roller 45. A support 46 is fitted so as to swing on the arm 44 through a pivot 47, and a guide pin 48 is engaged in an opening 49 shaped like an arc of a circle in the support 46. A rigid pipe 50 connected to a flexible hose 51 joined to a source of aspiration (not shown in this Figure) it fitted so as to run through two side brackets 52 of the support 46. The free end of the pipe 50 ends in a box 53 which has an opening 54 in its lower face (FIG. 10). The box 53 contains a cutting device that comprises two immobile blades 55 lying at a tangent to the edge of the opening 54 and one shearing blade 56 with two shearing edges, fitted so as to swivel around a shaft 57. An arm 58 solidly fixed to the double movable blade 56 is in contact with the piston 59 of a drive jack 60. The shearing blade 56 lies at the end of a springy strip 61 which serves to press the double blade 56 against the immobile blades 55.

The box 53 is solidly fixed to the end of a piston rod 62 of a jack 63. The rigid pipe 50 is connected to a rail 64 having two rollers 65 fixed to one end of an arm 66, of which the other end is solidly fixed to the pipe 50. The rail 64 comprises a vertical part and also a sloped part that is intended to make the support 46 swing clockwise when the piston rod 62 makes the pipe 50 go downwards to seek the production yarn being aspirated and to perform in this way the same function as the swinging pipe 17 of FIGS. 1 and 2. A valve 67 operated by a jack 68 lies on the hose 51 and serves to interrupt aspiration for the purpose which will be explained later.

The method of working of this variant is practically the same as that of the lay-out described earlier. At first the piston rod 62 brings the box 53 downwards and during this movement the rail 64 makes the support 46 swing on the pivot 47, and the pipe 50 takes up a sloped position as shown by the position drawn with dots and dashes on FIG. 8. Owing to the slope of the support 46 the box 53 is brought to the immediate neighbourhood of the yarn at the place where the yarn leaves the roller 5 (FIG. 1). The yarn is then sucked into the pipe 50, and the piston rod 62 is brought back to the position drawn with continuous lines and pulls with it the pipe 50 and the yarn sucked thereinto. During this movement the yarn is brought near the edge of the bobbin because of the swinging of the support 46, and in this way the formation of a reserve on the new tube thereafter is made possible.

The arm 44 then swings into the position of the arm 13 shown in FIG. 2 so as to discharge the bobbin, with help from the roller 45 to pull the yarn sucked in by the pipe 50.

When the bobbin has been discharged as previously, the shearing blade 56 (FIG. 10) is swung by the jack 60 and comes into a position symmetrical in relation to the opening 54. The yarn is cut between the shearing blade 56 and the immobile blades 55, above which the shearing blade 56 passes during its swinging movement, and the bobbin is thus separate from the pipe 50. The end of the yarn connected to the box continues to be aspirated during the operations which follow and which are the same as those described earlier for the arrangement detailed in FIGS. 1 to 7 inclusive up to the time of the re-starting of the winding of the yarn.

At that time the double blade 56 swings in the other direction and again shears the yarn so as to free it and enable it to coil around the new bobbin. At the same time the jack 68 closes the valve 67 and this stops the suction so as to facilitate release of the yarn. The remainder of the operations thereafter is the same as that described earlier with regard to FIGS. 1 and 7 inclusive.

Figure 9:
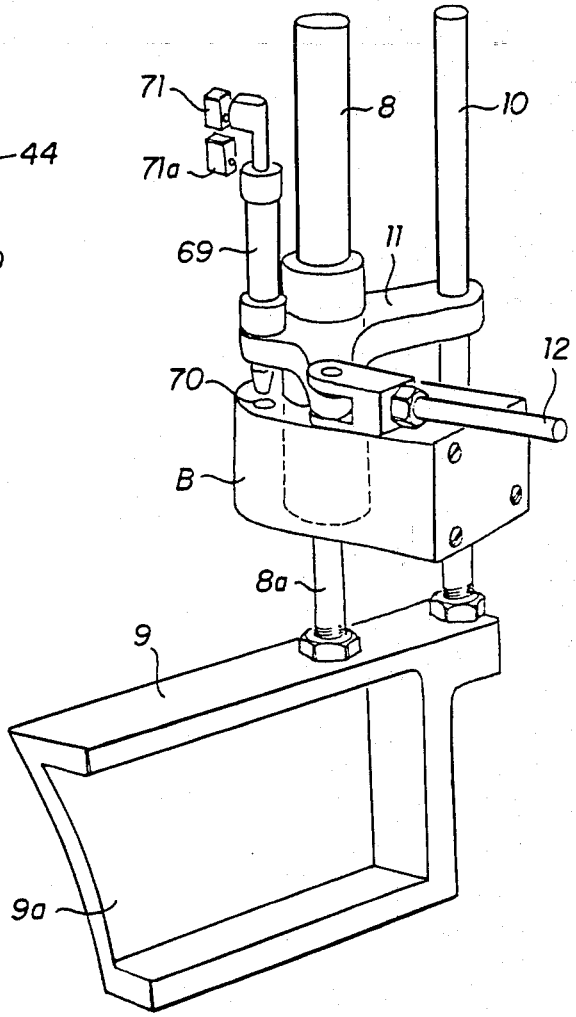
FIG. 9 is a partial perspective view of another variant.

The variant shown in FIG. 9 refers to the first part of the device serving to activate the stirrup 1. This Figure shows the jack 8, its rod 8*a*, the holding element 9 with its release end 9*a*, the rod 10 and the swivelling element 11 with its two branches and with its drive jack 12.

As explained earlier, the holding element 9 has to be able to take up positions at three different angles around the lengthwise axis of the rod 8*a*. Given the fact that it is hard to fix an accurate intermediate position by means of a jack, a positioning jack 69 is fixed to the two-branch swivelling element 11 in a position parallel to the lengthwise axis of the rod 8*a*. A positioning release 70 is arranged on a fixed part of the framework B of the device wherein the swivelling element 11 pivots. Two switches 71 and 71*a* arranged on the rod of the jack 69 are intended to detect the two ends of the run of this jack. The release means 70 is arranged opposite the rod of the jack 69 when the element 9 is in the position wherein the release means 9*a* lodges the arm of the stirrup 1 so as to raise it.

When the holding element 9 passes from the position of FIG. 1 to that of FIG. 2, the rod of the jack 69 is lowered against the fixed part of the framework B. As soon as this rod penetrates into the release means 70, the swivelling element is halted and at the same time the switch 71*a* cuts off the feed to the jack 12. Thereafter, when the holding element 9 has to pass on to its third position so as to separate the arms of the stirrup 1, the rod of the jack 69 is returned and activates the end-of-run switch 71. The switch serves to govern the feed for the jack 12 so as to halt the run thereof.

I claim:

1. A device to remove bobbins for an open-end spinning machine, wherein each bobbin is installed so as to rotate between two elastic holding elements of a supporting stirrup joined in an articulated manner to the frame of the machine, and rests against a drive shaft of said machine, comprising:

a gripping element for activating said stirrup, first and second rods pivotally fixed to said gripping element permitting that element a direction of movement in a plane perpendicular to the axis of articulation of said stirrup and adjacent to the inner face of one of the elements thereof, a swivelling element mounted on said rods to give said gripping element pivotable on said rods a direction of movement in a plane at right angles to the previous plane, hydraulic means to move said gripping element according to each of said directions of movement and between at least two respective limit positions, an arm to discharge the bobbin pivotable around an axis, an attachment to said arm that defines a trajectory of said arm which is passable between the elements of the stirrup when the stirrup is free of a dischargeable bobbin, a first jack to move said arm along its trajectory between at least two limit positions of rest and discharge, a yarn-suction pipe pivotally fixed to said attachment to draw yarn into said pipe during bobbin discharge and rewinding, a winding tube transfer mechanism, a second jack associated with said mechanism to transfer a tube from a supply storage point to a position between the holding elements of the stirrup, and shears within said attachment to free the yarn in said suction pipe when the arm is in its discharge position.

2. The device according to claim 1, including a third jack, said suction pipe defining a crosswise opening and wherein said shears comprise two blades one blade of which is immobile, the other blade of which swings, said blades being situated, while in their open position, one on either side of said crosswise opening in said suction pipe, whereby the swinging blade is associated with said third jack which can move said blade so as to shift it in an alternating manner across said crosswise opening.

3. The device according to claim 2, including a source of aspiration, said attachment including an impervious enclosure, said shears being located in said impervious enclosure from which emerges said crosswise opening of the suction pipe, whereby said enclosure is connected to the outlet end of said pipe and is also connected to said source of aspiration.

4. The device according to claim 1, wherein a portion of said suction pipe adjacent to its outlet is joined in an articulated manner to said arm in such a way that said portion can revolve around an axis essentially parallel to the trajectory of said arm including a fourth jack causing movement associated with said portion of the pipe so as to shift it between two limit positions, one position being where the trajectory described by its inlet, at the time of the displacement of the arm, is essentially in the middle between the holding elements of the stirrup, and the other position being where said trajectory is adjacent to one of the elements of the stirrup, a hook to bend the trajectory of the yarn, sliding means associated with said hook, and a fifth jack to shift said hook crosswise to the trajectory of the yarn between two limit positions, in one of which the end of said hook bends the trajectory of the yarn, whereby the inlet of said suction pipe, being placed on the yarn's trajectory adjacent to a holding element of the stirrup when the arm is in the discharge position, and said hook in its position to bend the yarn lie one on each side of a plane containing the holding elements of the stirrup, said stirrup being kept separate from said drive shaft by said gripping element, and whereby the trajectory that joins the inlet of the suction pipe to the end of the hook is adjacent to one holding element of the stirrup and passes inside the space occupied by a winding tube held between said holding elements, in such a way that, when a strand of yarn passes along said trajectory and when the tube holder activating the stirrup brings said winding tube against said drive shaft, one portion of the yarn pulled by said tube against the drive shaft is coiled outside the zone of the tube onto which winding is carried out, thus forming a reserve of yarn.

5. The device according to claim 1, including a swiveling element pivotal coaxially with said first rod, said second rod being parallel to said first rod and fitted so as to shift across said swiveling element and wherein said hydraulic means are jacks.

6. The device according to claim 1, wherein said winding tube transfer mechanism comprises a third rod, said second jack being attached to one end of said third rod, a gripper with jaws fitted to the other end of said third rod, one of the jaws of said gripper being fixed to said rod, the other jaw being movable and subject to some elastic return means that tend to maintain the gripping position, said movable jaw having a jutting portion intended to come into contact with a stop located on the path of said movable jaw in the neighborhood of the end of the run of said second jack bringing said gripper in front of said storage point, and a retaining element fixed to said gripper intended to move in front of the outlet of the storage point while the gripper is being moved towards the stirrup.

7. The device according to claim 1, wherein said attachment comprises a bushing, a sleeve surrounding said bushing to which is attached one end of said suction pipe, the axis of said sleeve being parallel to the trajectory of said arm, said fourth jack fixed to said sleeve to make said sleeve and suction pipe swing between two limit positions, one of said positions of said suction pipe having the inlet of said pipe in the middle between the holding elements of said stirrup and the other position having the inlet of said pipe adjacent one of the holding elements of said stirrup, said sleeve being fixed to said arm.

8. The device according to claim 2, including a pneumatically controlled valve to control the flow of air through said suction pipe.

9. The device according to claim 5, including a sixth jack carried by said swivel element, a support for said first rod defining a release for said sixth jack on the trajectory of said swivel element between two limit positions of said swivel element.

10. The device according to claim 1, including a box attached to said suction pipe containing a circular opening therein and said shears positioned within said box comprising two immobile blades positioned tangentially at two points of said circular opening and a springy strip defining a shearing blade with two shearing edges fitted so as to swing across said opening, said springy strip exerting pressure on said immobile blades at said shearing blade.

* * * * *